US005915350A

United States Patent [19]

Suzuki et al.

[11] Patent Number: 5,915,350

[45] Date of Patent: Jun. 29, 1999

[54] LUBRICATION SYSTEM FOR ENGINE

[75] Inventors: Takahiro Suzuki; Takeo Yoshida, both of Iwata, Japan

[73] Assignee: Yamaha Hatsudoki Kabushiki Kaisha, Iwata, Japan

[21] Appl. No.: 09/025,681

[22] Filed: Feb. 18, 1998

[51] Int. Cl.[6] ..... F01M 1/00

[52] U.S. Cl. ..... 123/196 R; 123/196 M

[58] Field of Search ..... 123/196 R, 196 M

[56] References Cited

U.S. PATENT DOCUMENTS

| | | | |
|---|---|---|---|
| 3,973,532 | 8/1976 | Litz | 123/75 CC |
| 4,261,305 | 4/1981 | Ikoma | 123/196 R |
| 4,364,307 | 12/1982 | Paro | 123/41.38 |
| 4,433,655 | 2/1984 | Villella | 123/196 R |
| 4,945,864 | 8/1990 | Soloman et al. | 123/41.39 |
| 5,333,955 | 8/1994 | Papa | 123/196 R |

*Primary Examiner*—John Kwon

*Attorney, Agent, or Firm*—Knobbe, Martens, Olson & Bear LLP

[57] ABSTRACT

An arrangement for lubricating the piston pin and associated bearing surfaces in a reciprocating machine wherein a charge is compressed in a crankcase chamber. The arrangement includes a groove in the cooperating bearing surfaces in which lubricant is retained. The opposite ends of the groove are exposed to different pressure areas in the engine that vary cyclically, but not in phase with each other so lubricant will be pumped back and forth in the groove during the cyclic engine operation.

15 Claims, 7 Drawing Sheets

LUBRICATION SYSTEM FOR ENGINE

BACKGROUND OF THE INVENTION

This invention relates to a lubrication system for an engine and, more particularly, to an improved lubrication system for lubricating the connection between the piston and the connecting rod of an engine in which the intake mixture is compressed at least, in part, in the crankcase chamber of the engine.

In two-cycle internal combustion engines and particularly those embodying crankcase compression principles, the engine is normally lubricated by delivering lubricant to the various components with the spent lubricant being passed out of the engine's exhaust system. This is done primarily because the crankcase chamber is not capable of functioning as a lubricant reservoir. Although this lubrication is frequently accomplished by mixing the lubricant with the fuel, such systems do not provide the optimum degree of lubricant for all running conditions. In addition, this type of systems requires fairly high oil concentrations in the fuel-air mixture to ensure that all components of the engine are adequately lubricated under high load conditions. Thus, these engines tend to consume a greater amount of oil than necessary for lubrication purposes at other running conditions and this oil enters the atmosphere through the exhaust.

There have also been provided systems wherein lubricant is added directly to the components to be lubricated from an external reservoir and wherein the lubricant is gradually depleted from this reservoir. Normally, the lubricant is directly delivered to the crankshaft bearings and to the sliding surfaces of the piston. However, the lubricant that is employed for lubricating the pivotal connection between the piston and piston pin and between the piston pin and connecting rod is normally accomplished by a mist-type system. Although some lubricant may be positively delivered in this area, generally the amount of lubricant required for these high stress surfaces is fairly high and, thus, smoke in the exhaust and other emission problems still are present.

It is, therefore, a principal object of this invention to provide an improved lubricating arrangement for the connection between the piston and connecting rod that will not require large amounts of lubricant.

It is further object of this invention to provide an improved method for lubricating the piston pin of an engine having crankcase compression and wherein the lubricating system is such that the oil is retained in the piston pin area so as to minimize the amount of lubricant that need be supplied.

SUMMARY OF THE INVENTION

This invention is adapted to be embodied in a lubricating system for an internal combustion engine that has an engine body that defines a cylinder bore with a combustion chamber formed at one end thereof and a crankcase chamber at the other end thereof A piston reciprocates in the cylinder bore and separates the combustion chamber from the crankcase chamber. The piston has at least one piston pin receiving bore. A crankshaft is rotatably journaled within the crankcase chamber. A connecting rod has a big end journaled on the crankshaft and a small end defining a piston pin receiving bore. A piston pin is received within the piston pin receiving bores of the piston and the connecting rod small end for connecting the piston to the connecting rod.

In accordance with a first feature of the invention, at least one groove is formed that extends from an area that is in direct communication with the crankcase chamber and which terminates in one of the piston pin receiving bores for permitting lubricant to be accumulated therein for lubricating the surfaces of the piston pin and the member in which the piston pin bore is formed.

In accordance with another feature of the invention, a groove is formed in an area that extends along the surface of the piston pin and is exposed at its opposite ends to areas where the pressure varies cyclicly so that a flow back and forth across the groove occurs during engine operation so as to maintain lubricant therein and to circulate back and forth along the groove.

DETAILED DESCRIPTION OF THE PREFERRED EMBODIMENTS OF THE INVENTION

Figure 1:
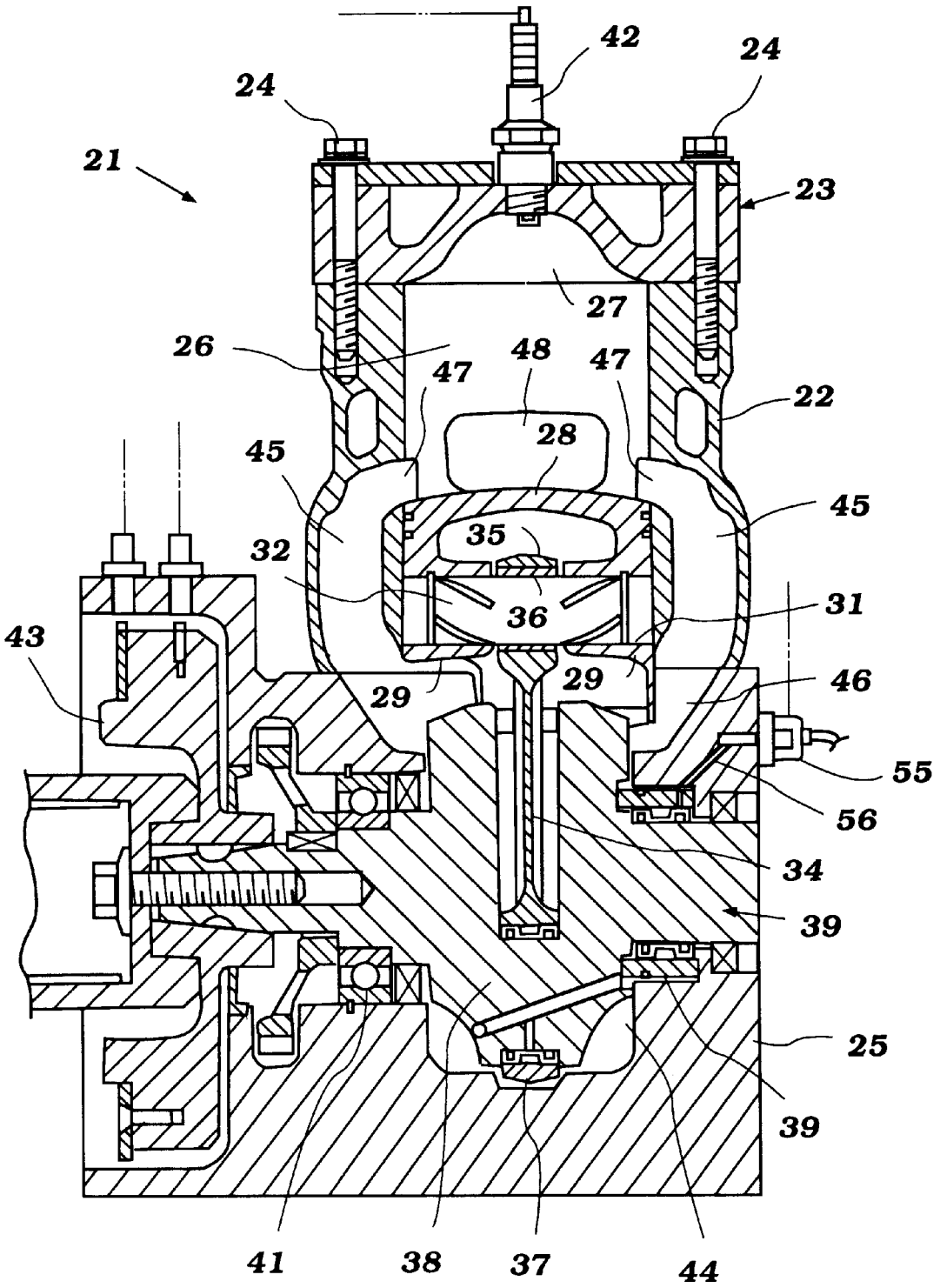
FIG. 1 is a cross-sectional view taken through a two-cycle crankcase compression engine constructed in accordance with a first embodiment of the invention.
Figure 2:
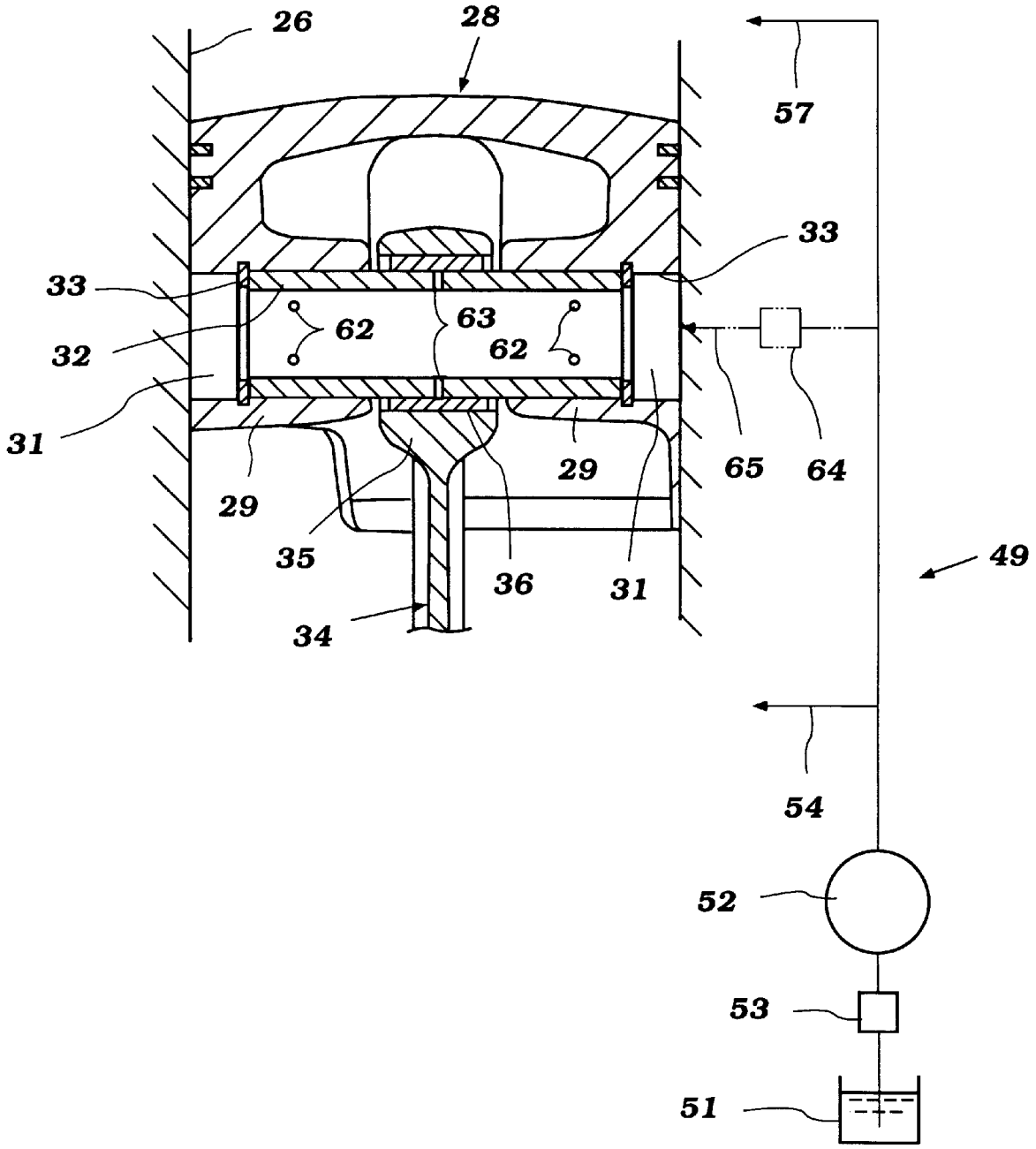
FIG. 2 is an enlarged cross-sectional view, looking in the same direction as FIG. 1, but showing the piston pin in cross-section and also illustrating the lubricant delivery system schematically.
Figure 3:
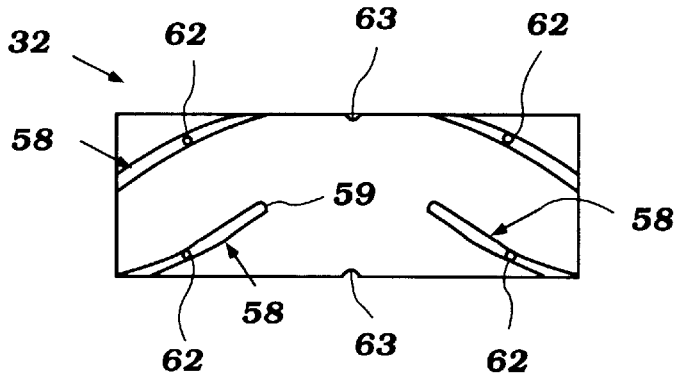
FIG. 3 is an enlarged side elevational view of the piston pin utilized with this embodiment.
Figure 4:
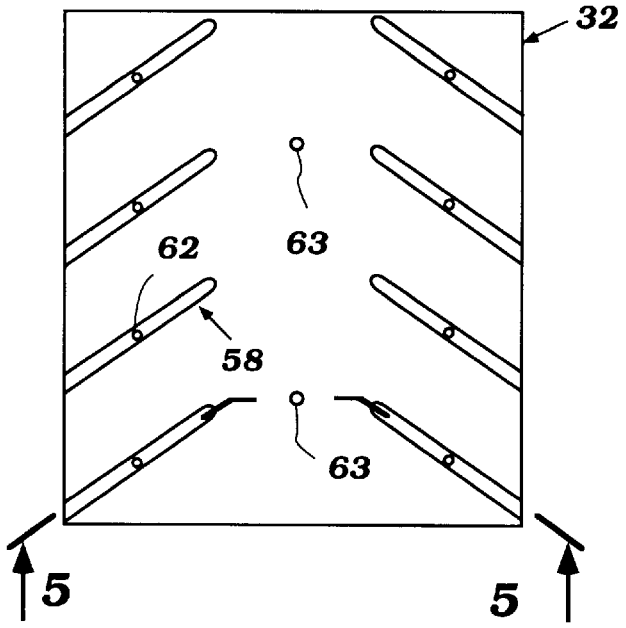
FIG. 4 is a developed view of the outer surface of the piston pin to show the lubricant groove arrangement.
Figure 5:
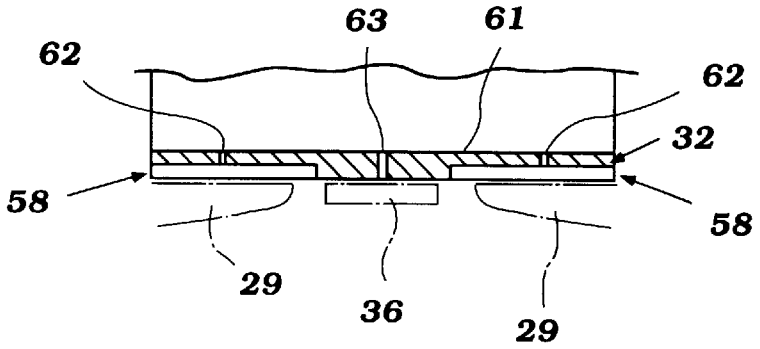
FIG. 5 is a cross-sectional view taken along the line 5—5 of FIG. 4.
Figure 12:
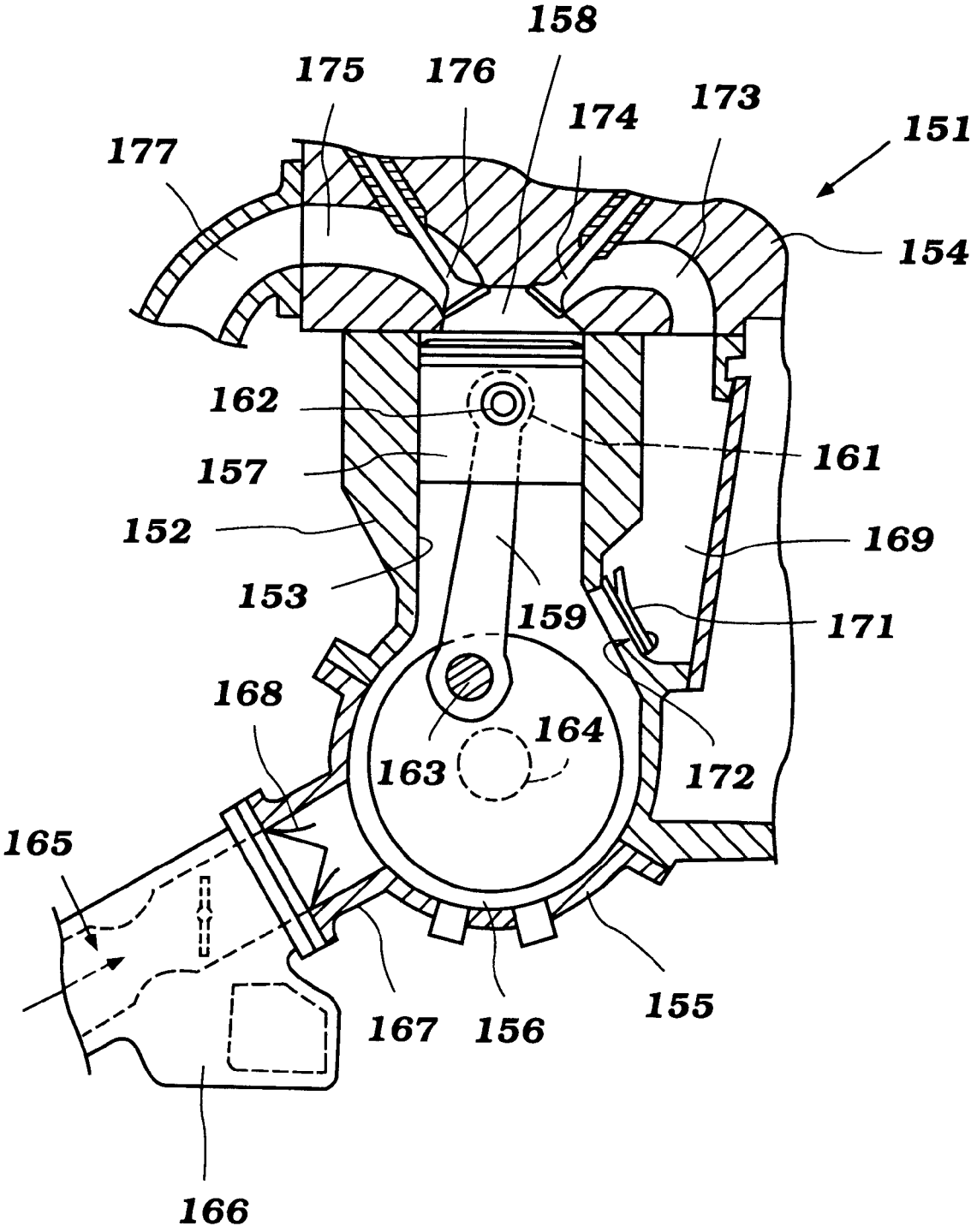
FIG. 12 is a cross-sectional view, in part similar to FIG. 1, but shows the application of the invention to a crankcase compression, four-cycle type of internal combustion engine.

Referring first to the embodiment of FIGS. 1–6 and initially primarily to FIGS. 1 and 2, a two-cycle, crankcase compression internal combustion engine constructed in accordance with this embodiment is identified generally by the reference numeral 21. Only a single cylinder engine is illustrated in this embodiment, but it will be readily apparent to those skilled in the art how the invention may be utilized in conjunction with engines having other cylinder numbers and other configurations. Also, although the invention is described in this embodiment in conjunction with a two-cycle, crankcase compression engine, as will become apparent by reference of the description of FIG. 12, the invention may also be utilized in conjunction with crankcase compression, four-cycle engines.

The engine 21 is comprised of an engine body that consists primarily of a cylinder block member 22, a cylinder head assembly 23 that is affixed to the cylinder block 22 by threaded fasteners 24 and a crankcase member, indicated generally by the reference numeral 25, which is mounted at the lower end of the cylinder block member 22 in any suitable manner.

The cylinder block member 22 is formed with a cylinder bore 26 which cooperates with a recess 27 formed in the underside of the cylinder head assembly 23 and a piston 28 to form a combustion chamber. The combustion chamber will at times be referred to and identified by the reference numeral 27 since at top dead center position the cylinder head recess 27 forms the substantial portion of the combustion chamber volume.

The piston 28 is formed with piston pin bosses 29 each of which is formed with a piston pin bore 31 in which a piston pin 32 is contained. The piston pin 32 is maintained in an axial position within the piston pin bores 31 by means of snap rings 33 retained within grooves formed in the piston pin bosses 29 around their bores 31.

A connecting rod, indicated generally by the reference numeral 34 has a small end 35 that is formed with a piston pin bore in which needle bearings 36 are received for providing a bearing coupling between the piston pin 32 and the connecting rod 34 so as to transmit motion from the piston 28 to the connecting rod 34.

The connecting rod 34 also has a big end 37 which is journaled on a throw 38 of a crankshaft 39. The crankshaft 39 is rotatably journaled within the crankcase member 25 by means of roller bearings 39 and a ball bearing assembly 41 disposed on opposite sides of its throw 38. As should be readily apparent, reciprocation of the piston 28 in the cylinder bore 26 causes the crankshaft 39 to rotate in a well-known manner.

A spark plug 42 is mounted in the cylinder head assembly 23 and is fired by a suitable ignition system such as a flywheel magneto powered system associated with a flywheel 43 that is affixed to one end of the crankshaft 39.

An air charge is delivered from a suitable source of atmospheric air to a crankcase chamber 44 that is formed by the crankcase member 45 and in which the crankshaft 39 rotates. A check valve arrangement (not shown) is provided in the intake port that serves the crankcase chamber 34 so as to permit the air charge to be drawn into the crankcase chamber 44 when the piston 28 moves upwardly in the cylinder bore 26. This check valve will close when the piston 28 moves downwardly for compression of the inducted air charge in the crankcase chamber 44.

The compressed charge is transferred from the crankcase chamber 44 to the combustion chamber 27 through one or more scavenge passages 45 that are formed, in part, in the cylinder block 22 and which extend from inlet openings 46 formed in the crankcase member 25 in communication with the crankcase chamber 44. These scavenge passages 45 terminate in scavenge ports 47 that open through the wall of the cylinder bore 26 and which are opened and closed by the movement of the piston 28 as is well-know in this art.

Fuel is added in an appropriate manner to the air charge and this may be done either by a carburetor which supplies a fuel-air mixture to the aforenoted intake system or by means of a fuel injector that injects fuel either into the intake system, the crankcase chamber 44, the scavenge passages 45 or directly into the combustion chamber 27. The fuel air charge thus formed is further compressed in the combustion chamber 27 as the piston 28 continues its upward movement and this compressed charge is fired by the spark plug 42.

Burning of the charge will cause expansion that drives the piston 28 downwardly and eventually an exhaust port 48 also formed in the cylinder bore 26 will be opened so as to permit the exhaust gases to be discharged. The exhaust port 48 communicates with a suitable exhaust system for discharge of the exhaust gases to the atmosphere.

The construction of the engine 21 as thus far described may be considered to be conventional and, where any components have not been illustrated or described, reference may be had to any known construction.

The invention deals primarily with an arrangement for lubricating the sliding area between the piston pin 32 and the piston pin bosses 29 of the piston 28 and the bearing surface of the connecting rod small end 35. In this embodiment, this includes lubrication of the needle bearing 36.

FIG. 2 shows an arrangement wherein lubricant is delivered to the engine by a lubricating system indicated generally by the reference number 49 and which includes a lubricant reservoir 51 from which lubricant is drawn by a lubricating pump 52 through a supply conduit in which a filter 53 is positioned. This pressurized lubricant is delivered to a first supply line 54 which communicates with a metering device 55 (FIG. 1). The metering device 55 delivers lubricant in measured quantities through a passage 56 to lubricate the main bearing 39 and also to supply lubricant past the main bearing 39 into the crankcase chamber 34.

A second lubricant line 57 may extend from the pump 52 to another metering device positioned in the cylinder block member 22 that communicates with an area of the cylinder bore 26 across which the piston 28 reciprocates. This will lubricate the sliding surfaces between the piston 28 and the cylinder block member 22. Again, this portion of the lubricating system, as thus far described, may also be considered to be conventional or of any known type.

Figure 6:
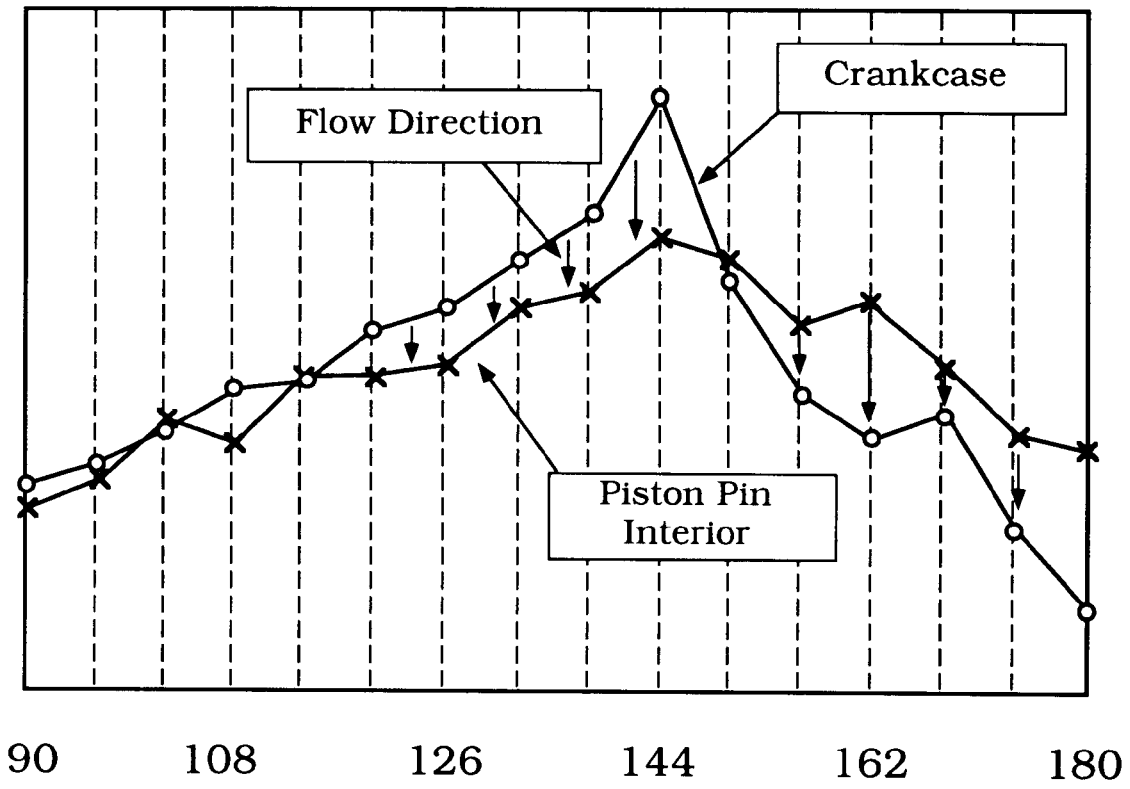
FIG. 6 is a graphical view showing the pressure in the interior of the piston pin and in the crankcase chamber during a portion of the cycle showing how the pressure varies between the ends of the lubricant grooves and illustrates the direction of lubricant flow along the grooves due to these pressure differences.

The aforenoted surfaces of the piston pin 32, piston pin bosses 29 and connecting rod small end 35 are lubricated by an arrangement which is shown best in FIGS. 2-5 and the operation of which may be understood by reference to FIG. 6.

In this embodiment, the piston pin 32 is formed with a plurality of lubricant retaining grooves 58. The grooves 58 have a first end portion 59 which is of sufficient length so as to be placed in the area between the inner terminations of the piston pin bosses 29 and in an area outside of the connecting rod small end 35. As a result, these end portions 59 will be exposed to the pressure in the crankcase chamber. This will permit oil mist from the crankcase chamber to enter the grooves 58 through the open ends 59.

The grooves 58 may extend to the outer ends of the piston pin 32 and will be basically closed by the snap rings 33 so as to ensure that the grooves 58 will be in substantially constant communication with the crankcase chamber 44 and be at substantially the same pressure as the crankcase chamber 44.

As is typical with piston pin constructions, the piston pin 32 is hollow having a bore 61 that extends therethrough. This bore 61 is communicated with the grooves 58 through drilled passages 62 that extend from each of the grooves 58 in a generally radial direction. These drilled passages 62 communicate the grooves 58 with the interior or bore 61 of the piston pin 32. Because of the restricted size of the drilled passages 62, the pressure within the piston pin bore 61 will be different, at most times, from the pressure in the crankcase chamber 44 and the pressure at the delivery ends 59 of the grooves 58. The significance of this will be described shortly.

The piston pin bore 61 is communicated with the small end of the connecting rod 35 so as to lubricate the needle bearings 36 by means of a plurality of a further drilled passages 63. The passages 63 are formed in a location which will be located between the ends of the needle bearings 36 and which will be at a pressure that is different from the crankcase pressure since there is only restricted communication between the piston pin bore 31 and the crankcase chamber 44, as aforenoted.

As has been previously noted, when the piston 28 begins its down stroke, the charge which has been drawn into the crankcase chamber 44 will begin to be compressed. This causes the pressure in the crankcase chamber 44 to rise with this pressure increase eventually reaching a point at approximately 110 ☜ after top dead center when the pressure inside the piston pin bore 31 is exceeded for the reasons aforenoted. Thus, there will be a flow of air and entrained lubricant mist flow into the grooves 58 from their inlet ends 59. This lubricant will fill the grooves 58 and also pass through the drilled passages 62 into the hollow piston pin interior 61. This will also permit the lubricant to pass through the drilled passages 63 to lubricate the connecting rod needle bearings 36.

As the piston continues its downward movement, first the exhaust port 48 will open and then the scavenge ports 47 will open. This causes the pressure in the crankcase chamber to drop off as shown in FIG. 6. At approximately 150 ☜ after top dead center, the pressure in the crankcase chamber will be lower than the pressure in the interior of the piston pin bore 61 and, hence, flow will occur from the piston pin bore 61 back to the crankcase chamber 44, not only through the drilled opening 62 and grooves 58, but also through the drilled opening 63 and across the connecting rod small end bearings 36. Thus, rather than being discharged with the exhaust gases, the lubricant which lubricates the piston pin 32, the receiving portion of the piston pin bosses 29 and the connecting rod small end 35 will always be present and any lubricant which does escape will escape into the crankcase chamber 44 rather than into the combustion chamber 27.

Although with the construction as thus far described, it is not necessary to provide any lubricant directly from the lubricant pump 52 to the interior of the piston pin 32, it is also possible to incorporate a lubricating system that does so supply lubricant. Such a system is illustrated in phantom in FIG. 2 and includes a further lubricant metering device 64 that supplies lubricant through a port 65 that is aligned with the piston pin bore 31 of one of the piston pin bosses 29 during a portion of the piston stroke.

The metering device 64 can be operated in timely relationship so as to supply lubricant through the piston pin bore 31 to the opening 61 in the piston pin 32. This lubricant will be retained in this are and in the bearing areas by the aforenoted pumping action caused by the pressure differences.

Figure 7:
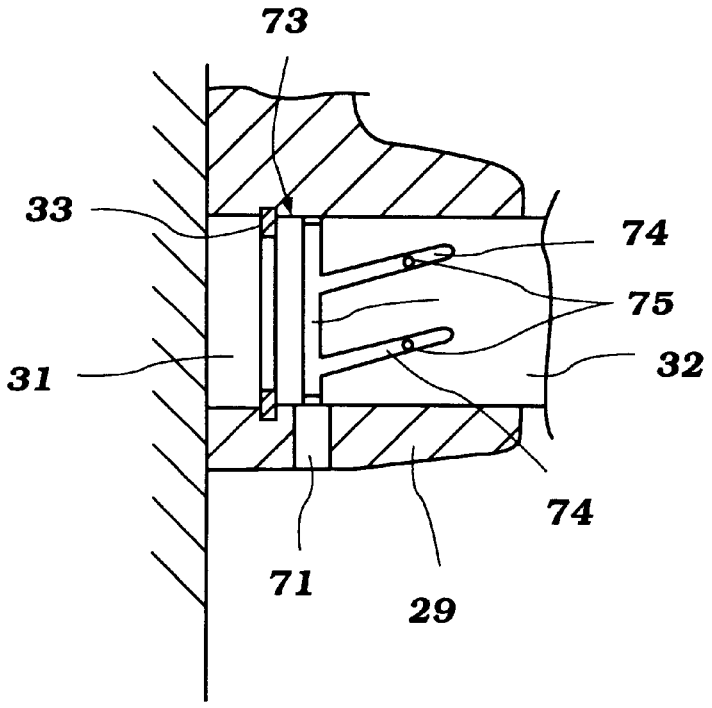
FIG. 7 is a cross-sectional view taken through one end of the piston pin receiving bosses of a piston and piston pin arrangement showing a second embodiment of the invention.

FIG. 7 shows another embodiment of the invention which differs from the embodiment previously described only in the location of the piston pin grooves and the manner in which lubricant is delivered to them. For that reason, only a partial view is believed to be necessary to show this embodiment. Also, where portions of this embodiment are the same as those previously described, those components are identified by the same reference numeral and will be described again only insofar as is necessary to understand the construction and operation of this embodiment.

In this embodiment, the piston pin bosses 29 are provided with oil receiving apertures 71 which are substantially large and unrestricted and fact downwardly toward the crankcase chamber 44. During the downward movement of the piston 28, oil can flow through these openings 71 and enter a circumferential recess or groove 72 formed in the respective ends of the piston pin 32. Outwardly of the grooves 72, there are formed land portions 73 that acts as a seal and prevent the lubricant from flowing outwardly past the piston pin 32 to the open part of the boss bores 31 on the outer side of the snap rings 32. Grooves 74 are formed in intersecting relationship with each of the grooves 72 and extend generally in an axial direction, although they may be helically formed if desired. These grooves 74 are each formed with one or more cross-drillings 75 which extend into the hollow interior of the piston pin bore 61 for transmitting lubricant therealong to the cross-drillings 63 that lubricate the connecting rod small end bearings 36.

Figure 8:
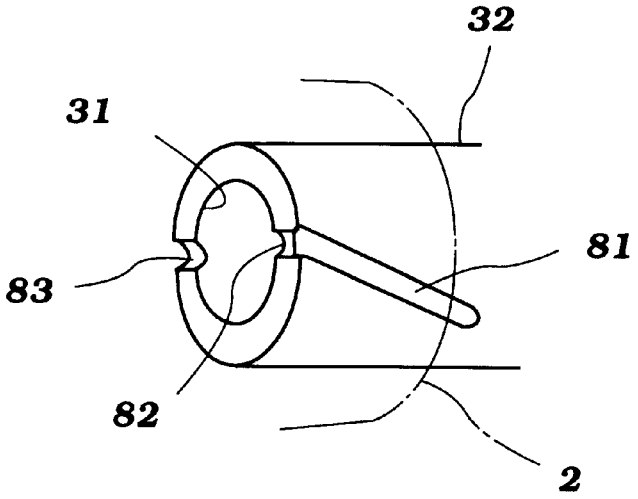
FIG. 8 is a perspective view showing the piston pin of a third embodiment of the invention in connection with the piston pin boss as shown in phantom.

FIG. 8 shows another embodiment using end of piston grooves, indicated generally by the reference number 81, that are formed in the piston pins 32. These grooves 81 extend to the ends of the piston pin that are engaged by the snap rings 33. The snap rings 33 which are not shown in this figure, therefore, acts to close the ends of the grooves 81. The grooves 81, however, communicate with the piston pin bore 31 through notches 82 formed at the piston pin end portions of the grooves 81.

As may been seen in FIG. 8, the grooves 81 extend axially inwardly of the piston pin bosses 29 and, hence, are in open facing relationship with the crankcase chamber 44 so as to receive the lubricant mist therefrom.

Figure 9:
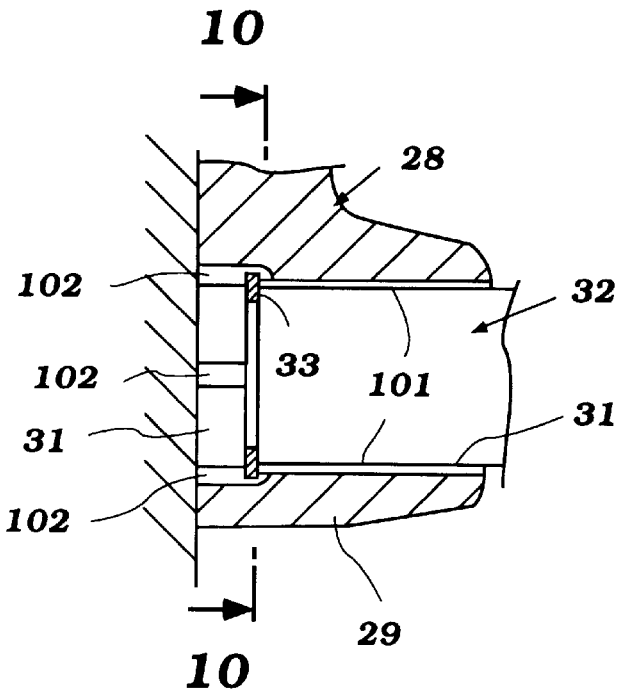
FIG. 9 is a cross-sectional view, in part similar to FIG. 7, and shows a fourth embodiment.
Figure 10:
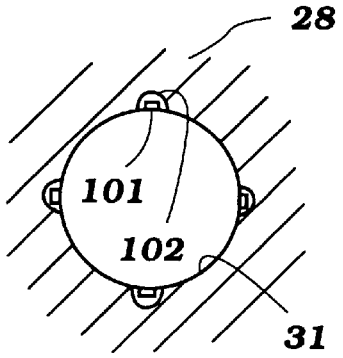
FIG. 10 is a cross-sectional view taken the line 10—10 of FIG. 9.

FIGS. 9 and 10 show yet another embodiment of the invention wherein a different form of groove arrangement is employed for trapping the lubricant. In this embodiment, the grooves are formed in the piston pin bosses 29 rather than in the piston pin 32 itself. In this embodiment, the piston pin bosses 29 are formed with circumferentially spaced grooves 101 that extend radially of the piston 28 and axially of the piston pin boss openings 31. These grooves 101 meet with larger co-axial grooves 102 formed in the outer portion of the piston 28 from the bore 31. These larger grooves 102 in essence bypass the snap rings 33 and, thus, permit the lubricant to flow from the grooves 101 into the hollow interior of the piston pin 32.

Since the grooves 101 extend to the inner ends of the piston pin bosses 29, they will be directly exposed to the crankcase chamber and, hence, crankcase pressure will exist in the grooves 101 when the crankcase is at a higher pressure than the interior of the piston pin bore 61. As a result, lubricant will flow in the previously-described manner. The restriction to pressure increases in the piston pin bore 61 is provided by the restriction of the passages or grooves 101.

Figure 11:
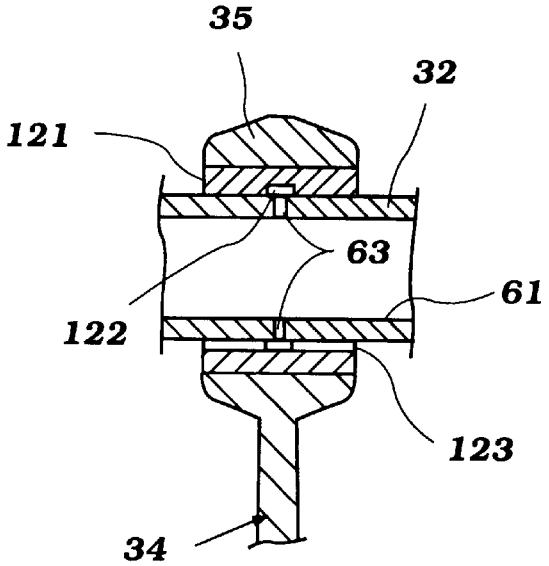
FIG. 11 is a cross-sectional view of the connection between the piston pin and connecting rod of a fifth embodiment of the invention.

In the previously-described embodiments, the piston pin 32 has been journaled in the connecting rod small end 34 by needle bearings. FIG. 11 shows an embodiment wherein a plane bearing, indicated generally by the reference numeral 121 is provided in the small end 31 of the connected rod 34.

The piston pin drillings 63 communicate the interior surface 61 of the piston pin with a enlarged groove 122 formed in the plane bearing 121. This enlarged groove 122 communicates with a small slot 123 that extends transversely through the bearing 121 so as to trap lubricant for the lubrication of the piston pin 32 and surface of the bearing 121. Preferably, this groove is helically formed as are the grooves in the other embodiments. Of course, if straight grooves are desired, they can be used although helical ones are preferred for stress reducing purposes.

All of the embodiments thus far described have dealt with two-cycle crankcase compression engines. As has been previously noted, however, the invention can also be employed in conjunction with a four-cycle engine that also employs crankcase compression and, thus, requires a separate lubricating system rather than a recirculating system. FIG. 121 shows such an embodiment in partial cross-section.

A four-cycle crankcase compression engine operating in accordance with this principle is indicated generally by the reference number 151. This engine 151 includes a cylinder body that includes a cylinder block 152 in which one or more cylinder bores 153 are formed. One end of the cylinder bores 153 is closed by a cylinder head assembly, indicated by the reference numeral 154, that is detachably connected to the cylinder block 152 in a know manner to form the combustion chamber. The opposite end of the cylinder bore 153 is closed by a crankcase member 155 that is affixed to the cylinder block 152 in a known manner. Thus, a crankcase chamber 156 is formed at this end.

A piston 157 reciprocates in the cylinder bore 153 and describes the crankcase chamber 156 from the combustion chamber, indicated generally by the reference numeral 158, and which is formed in major portion by a recess in the cylinder head surface 154 that faces the cylinder block 152.

A connecting rod 159 has its small end 161 journaled on a piston pin, indicated generally by the reference numeral 162, in any of the manners previously described. This piston pin 162 is also journaled in piston pin bosses (not shown) as of the type described in any of the preceding embodiments. That is, the use of bosses and piston pin 162 are formed with respective grooves for lubrication purposes in any of the manners previously described.

The connecting rod 159 has a big end 163 that is journaled on a throw of a crankshaft 164 that is rotatably journaled in the crankcase chamber 156 in any known manner.

An induction and charge-forming system, indicated generally by the reference numeral 165, is provided for supplying a fuel air charge to the crankcase chamber 156. This includes a charge former, such as a carburetor 156. This carburetor 166 delivers a fuel air charge to an intake port formed in an extension 167 of the crankcase member 155. A reed-type check valve 168 is provided in this intake port for the reasons afore-described.

In this embodiment, the intake charge that is drawn into the crankcase chamber during each stroke of the piston is compressed and delivered to an accumulator or pressure chamber 169 formed at one side of the cylinder block 152. A reed-type check valve 171 is provided in a pressure port 172 so as to permit the compressed charge to enter the chamber 169 and be trapped therein.

The chamber 169 communicates with an intake passage 173 formed in the cylinder head 154 and which terminates at the combustion chamber 158 through an intake valve seat. This valve seat is valved by an intake valve 174 that is operated in timed relationship with the crankshaft 164 in a known manner so as to open and close on every second rotation of the crankshaft 164 in typical four cycle operation.

The burnt charge which has been fired by a spark plug (not shown) every other reciprocation of the piston 157 is discharged through an exhaust passage 175 which is formed in the cylinder head 154. Like the intake passage 173, the exhaust passage 175 is opened and closed by means of an exhaust valve 176 which is also operated in any suitable manner. An exhaust manifold 177 collects the exhaust gases from the cylinder head exhaust passages 175 and discharges them to the atmosphere.

The engine 151 may be provided with any of the types of lubricating systems described previously. Because of the full descriptions of these systems in connection with a two-cycle engine, it is believed that those skilled in the art will readily understand how they can be practiced with a four-cycle engine have crankcase compression.

Thus, from the foregoing description, it should be readily apparent that the various embodiments described provide very effective manners of lubricating the piston pin and its bearings surfaces with the piston and connecting rod in engines having crankcase compression. Although the foregoing description is that of preferred embodiments of the invention, various changes and modifications may be made without departing from the spirit and scope of the invention, as defined by the appended claims.

We claim:

1. A lubricating system for a crankcase compression internal combustion engine comprising an engine body defining a cylinder bore with a combustion chamber formed at one end thereof and a crankcase chamber at the other end thereof, a piston reciprocating in said cylinder bore and separating said crankcase chamber from said combustion chamber, reciprocation of said piston in said cylinder bore being effective to cause the pressure in said crankcase chamber to vary cyclically during a cycle of operation of said engine, a crankshaft rotatably journaled in said crankcase chamber, a connecting rod connected at one end to said crankshaft for driving said crankshaft, a piston pin having a first portion journaled in a piston pin bearing surface formed in said piston for driving said piston pin upon reciprocation of said piston and a second portion journaled in a piston pin bearing surface of said connecting rod for driving said connecting rod, and a groove formed between at least one of said piston pin portions and said piston pin bearing surfaces for entrapping lubricant and lubricating the respective piston pin portion and the associated piston pin bearing surface, one end of said groove being exposed to the pressure in said crankcase during at least part of the engine operating cycle and the other end of said groove being exposed to a hollow interior of said piston pin for effecting back and forth movement of lubricant in said groove upon reciprocation of said piston in said cylinder bore.

2. A lubricating system as set forth in claim 1, wherein the first portion of the piston pin is received in a boss formed by the piston and the groove is formed between the boss and the first piston pin portion.

3. A lubricating system as set forth in claim 2, wherein the groove is formed in the piston pin.

4. A lubricating system as set forth in claim 3, wherein there is a plurality of circumferentially spaced grooves in the piston pin.

5. A lubricating system as set forth in claim 4, wherein a groove is also formed in a bearing formed in the small end of the connecting rod around the second piston pin portion.

6. A lubricating system as set forth in claim 1, wherein the groove is formed by the second piston pin portion and the connecting rod.

7. A lubricating system as set forth in claim 4, wherein the groove is formed in a bearing formed in the small end of the connecting rod.

8. A lubricating system for a crankcase compression internal combustion engine comprising an engine body defining a cylinder bore with a combustion chamber formed at one end thereof and a crankcase chamber at the other end thereof a piston reciprocating in said cylinder bore and separating said crankcase chamber from said combustion chamber, a crankshaft rotatably journaled in said crankcase chamber, a connecting rod connected at one end to said crankshaft for driving said crankshaft, a piston pin having a first portion journaled in a piston pin bearing surface formed in said piston for driving said piston pin upon reciprocation of said piston and a second portion journaled in a piston pin bearing surface of said connecting rod for driving said connecting rod, and means for forming a lubricant retaining passage between said piston pin and one of its bearing surfaces, means for communicating the opposite ends of said lubricant retaining passage with areas having pressures that vary cyclically during a single stroke of the piston and wherein the pressures vary differently from each other for establishing a back and forth flow of lubricant in said lubricant retaining passage.

9. A lubricating system as set forth in claim 8, wherein the first portion of the piston pin is received in a boss formed by the piston and the passage is formed between the boss and the first piston pin portion.

10. A lubricating system as set forth in claim 9, wherein the passage is formed in the piston pin.

11. A lubricating system as set forth in claim 10, wherein there is a plurality of circumferentially spaced passages in the piston pin.

12. A lubricating system as set forth in claim 10, wherein the passage is formed in the piston.

13. A lubricating system as set forth in claim 12, wherein there is a plurality of circumferentially spaced passages formed in the piston.

14. A lubricating system as set forth in claim 9, wherein the passage is formed by the second piston pin portion and the connecting rod.

15. A lubricating system as set forth in claim 8, wherein the passage is formed in a bearing formed in the small end of the connecting rod.

* * * * *